US012487051B2

(12) United States Patent
Kung et al.

(10) Patent No.: US 12,487,051 B2
(45) Date of Patent: Dec. 2, 2025

(54) ASSEMBLED ELECTRIC TOY GUN HAVING FUNCTION OF RAPIDLY CONNECTING AND TERMINATING ELECTRIC SIGNAL

(71) Applicant: VEGA FORCE INTERNATIONAL CORP., Taoyuan (TW)

(72) Inventors: Shih-Che Kung, Taoyuan (TW); Wei-Hung Chung, Taoyuan (TW)

(73) Assignee: VEGA FORCE INTERNATIONAL CORP., Taoyuan (TW)

( * ) Notice: Subject to any disclaimer, the term of this patent is extended or adjusted under 35 U.S.C. 154(b) by 305 days.

(21) Appl. No.: 18/219,150

(22) Filed: Jul. 7, 2023

(65) Prior Publication Data

US 2024/0350937 A1 Oct. 24, 2024

(30) Foreign Application Priority Data

Apr. 20, 2023 (TW) ..... 112203686

(51) Int. Cl.
*F41B 11/89* (2013.01)
*A63H 33/18* (2006.01)
*F41B 11/71* (2013.01)

(52) U.S. Cl.
CPC ..... *F41B 11/89* (2013.01); *A63H 33/18* (2013.01); *F41B 11/71* (2013.01)

(58) Field of Classification Search
CPC ..... F41B 11/70; F41B 11/71; F41B 11/89; A63H 33/18
USPC ..... 446/473; 124/32, 71, 77
See application file for complete search history.

(56) References Cited

U.S. PATENT DOCUMENTS 1,059,405 A * 4/1913 Sprague ..... F41A 3/58 42/8
3,153,874 A * 10/1964 Raymond ..... F41A 19/41 42/8
4,999,939 A * 3/1991 Reese ..... F41A 11/02 42/40
5,160,795 A * 11/1992 Milliman ..... F41B 11/723 124/48
5,727,538 A * 3/1998 Ellis ..... F41B 11/52 124/32

(Continued)

FOREIGN PATENT DOCUMENTS

CN 217980013 U * 12/2022
CN 117516263 A * 2/2024 ..... F41C 23/04

(Continued)

*Primary Examiner* — Alexander R Niconovich
(74) *Attorney, Agent, or Firm* — HDLS IPR SERVICES; Chun-Ming Shih

(57) ABSTRACT

An assembled electric toy gun having a function of rapidly connecting and terminating an electric signal includes a first gun body disposed with two first conductive sheets and a second gun body disposed with two second conductive sheets. The second gun body rotates relative to the first gun body in two opposite directions to respectively form a rotating assembly way and a bending detach way, each of the second conductive sheets is correspondingly in contact with each of the first conductive sheets at a terminal end of the rotating assembly way to establish an electric conduction, and each of the second conductive sheets is correspondingly separated with each of the first conductive sheets at a terminal end of the bending detach way to terminate the electric conduction.

9 Claims, 10 Drawing Sheets

(56) References Cited

U.S. PATENT DOCUMENTS 6,273,079 B1 * 8/2001 Jzn ..... F41B 11/52 124/45
6,615,814 B1 * 9/2003 Rice ..... F41B 11/723 124/71
6,644,293 B2 * 11/2003 Jong ..... F42B 39/02 124/52
7,806,113 B2 * 10/2010 Skilling ..... F41B 11/724 124/73
8,360,042 B2 * 1/2013 Skilling ..... F41B 11/70 124/71
8,485,858 B2 * 7/2013 Wei ..... F41B 11/89 446/473
8,827,706 B2 * 9/2014 Hogan, Jr. ..... G09B 19/00 434/18
8,893,695 B2 * 11/2014 Liao ..... F41B 7/08 124/40
9,109,853 B2 * 8/2015 Higgins ..... F41A 19/69
9,568,261 B1 * 2/2017 Hall ..... F41A 3/66
9,897,408 B2 * 2/2018 Liao ..... F41B 11/71
9,995,556 B2 * 6/2018 Hall ..... F41C 7/11
10,704,860 B2 * 7/2020 Hall ..... F41A 11/04
10,866,058 B2 * 12/2020 Maeda ..... F41B 7/08
11,378,351 B2 * 7/2022 Liao ..... F41B 11/89
11,454,472 B2 * 9/2022 Kung ..... F41B 11/723
11,466,949 B2 * 10/2022 Kellgren ..... F41A 21/30
11,982,507 B2 * 5/2024 Liao ..... F41B 4/00
12,013,206 B1 * 6/2024 Kung ..... F41B 11/55
2007/0202468 A1 * 8/2007 Iwasawa ..... F41G 1/35 434/21
2009/0199834 A1 * 8/2009 Skilling ..... F41B 11/721 124/71
2012/0208430 A1 * 8/2012 Kung ..... F41B 11/646 446/473
2019/0293383 A1 * 9/2019 Skilling ..... F41B 11/723
2019/0346231 A1 * 11/2019 Ma ..... F41A 11/04
2024/0247896 A1 * 7/2024 Liao ..... F41B 11/89
2025/0198715 A1 * 6/2025 Lin ..... F41A 9/83

FOREIGN PATENT DOCUMENTS

CN 221404068 U * 7/2024
JP 2006170473 A * 6/2006
JP 2006170474 A * 6/2006
TW 201730505 A * 9/2017

* cited by examiner

ASSEMBLED ELECTRIC TOY GUN HAVING FUNCTION OF RAPIDLY CONNECTING AND TERMINATING ELECTRIC SIGNAL

SUMMARY OF THE DISCLOSURE

Technical Field

The present disclosure relates to an electric toy gun, especially to an assembled electric toy gun having a function of rapidly connecting and terminating an electric signal.

Description of Related Art

In a related-art assembled electric toy gun, a power supplying unit and a power consuming unit are required to be provided. The power supplying unit is used to supply electric power to the power consuming unit. The power consuming unit is used to generate dynamic power via the received electric power.

In order to repair or replace objects or components in a gun body, the gun body of the toy gun is designed as two gun bodies which may be mutually assembled and detached. When the objects or the components in the gun body are needed to be repaired or replaced, the repairing or replacing operation may be easily operated through detaching the two gun bodies.

In the related-art assembled electric toy gun, the power supplying unit and the power consuming unit are respectively disposed in the two gun bodies, thus two conductive wires are used to connect the power supplying unit and the power consuming unit disposed in the two gun bodies to make an electric signal between the power supplying unit and the power consuming unit be electrically conducted. In order to disconnect each conductive wire through detaching the two gun bodies, a male connection head and a female connection head, capable of being mutually and electrically connected, are disposed at terminating location. As such, when the repairing or replacing operation is processed, one of the gun bodies is detached, and a labor force required for a manual manner is needed to detach the male connection head and the female connection head of each of the conductive wires, thus a function of rapidly terminating the electric signal is not provided. When the repairing or the replacing operation is finished, the two gun bodies are assembled again, and the male connection head and the female connection head of each of the conductive wires are mutually engaged before the two gun bodies are assembled, thus a function of rapidly connecting the electric signal is not provided.

In other words, the design of the male connection head and the female connection head is to make the two gun bodies be mutually detached in the related-art assembled electric toy gun, the labor force is still required to manually engage or detach the male connection head and the female connection head of each of the conductive wires when the two gun bodies are assembled or the two gun bodies are detached. As such, it is easy to be understood that there are problems of not being provided with the function of rapidly connecting and terminating the electric signal in the detaching and assembling operation of the two gun bodies of the related-art assembled electric toy gun.

Accordingly, the applicant of the present disclosure has devoted himself for improving the mentioned shortages.

SUMMARY OF THE DISCLOSURE

The present disclosure is to provide an assembled electric toy gun having a function of rapidly connecting and terminating an electric signal.

Accordingly, the present disclosure provides an assembled electric toy gun having a function of rapidly connecting and terminating an electric signal, which includes: a first gun body, having a first connection part and a pair of first conductive sheets disposed corresponding to the first connection part; and a second gun body, having a second connection part and a pair of second conductive sheets disposed corresponding to the second connection part: wherein, the first connection part and the second connection part are rotatably connected to form a bending part, the second gun body rotates relative to the first gun body in two opposite directions via the bending part to respectively form a rotating assembly way and a bending detach way, each of the second conductive sheets is correspondingly in contact with each of the first conductive sheets at a terminal end of the rotating assembly way to establish an electric conduction, and each of the second conductive sheets is correspondingly separated with each of the first conductive sheets at a terminal end of the bending detach way to terminate the electric conduction.

Advantages achieved by the present disclosure are as follows. Each of the first conductive sheets and each of the second conductive sheets are in contact or separated with each other by rotating and assembling the second gun body or bending the second gun body relative to the first gun body, thus an effect of rapidly connecting or terminating the electric signal is provided.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION OF THE DISCLOSURE

The technical contents of this disclosure will become apparent with the detailed description of embodiments accompanied with the illustration of related drawings as follows. It is intended that the embodiments and drawings disclosed herein are to be considered illustrative rather than restrictive.

The present disclosure provides an assembled electric toy gun having a function of rapidly connecting and terminating an electric signal (hereinafter referred as an electric toy gun). Please refer to FIG. 1, the electric toy gun includes a first gun body 100 and a second gun body 500 capable of being rotatably connected. A power supplying unit and a power consuming unit (the power supplying unit and the power consuming unit are both not shown in figures) are respectively disposed in the first gun body 100 and the second gun body 500. The power supplying unit and the power consuming unit are respectively connected to a pair of first conductive wires 3 and a pair of second conductive wires 7.

Figure 9:
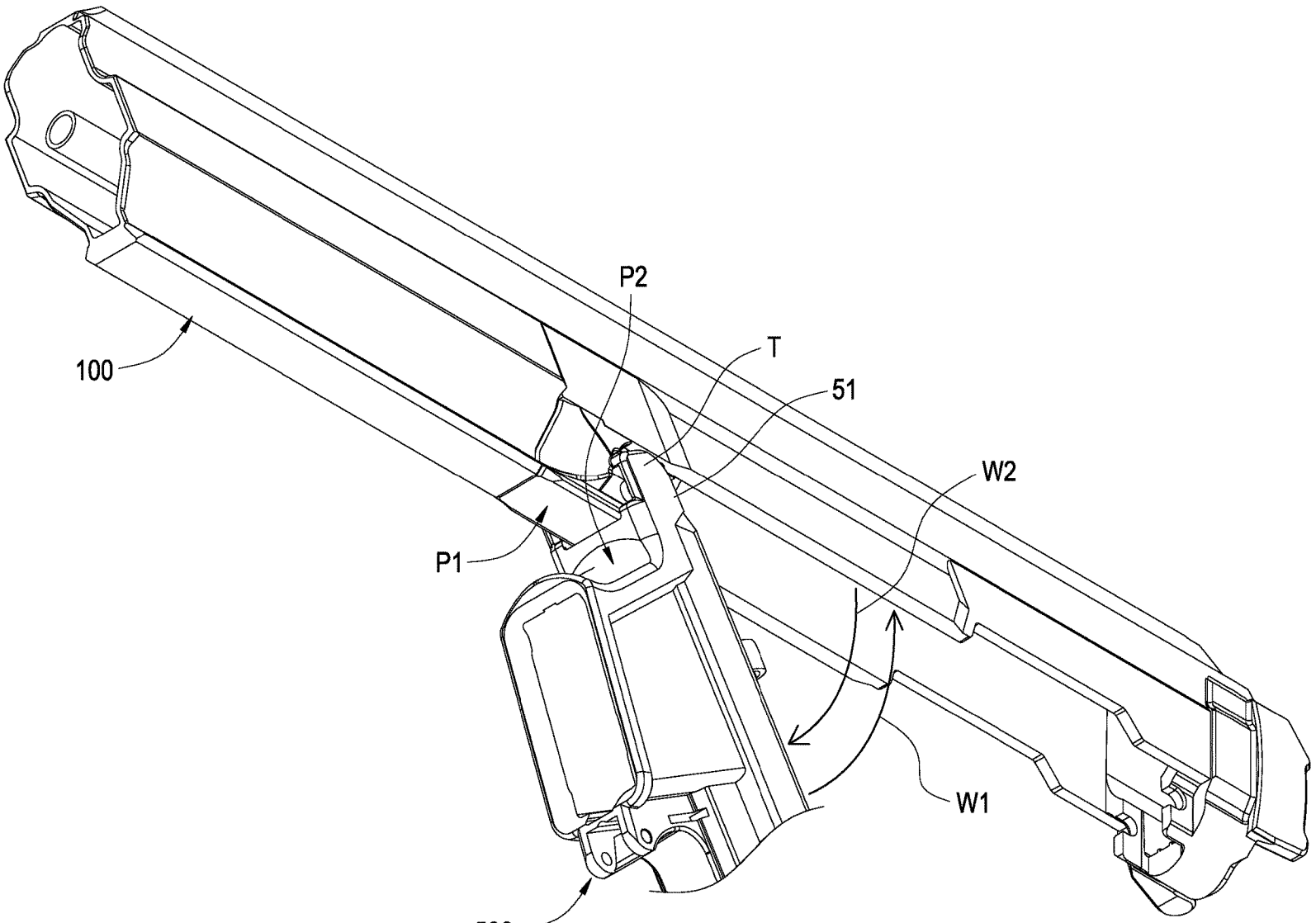
FIG. 9 is a perspective view showing the second gun body being bent relative to the first gun body according to the present disclosure.
Figure 10:
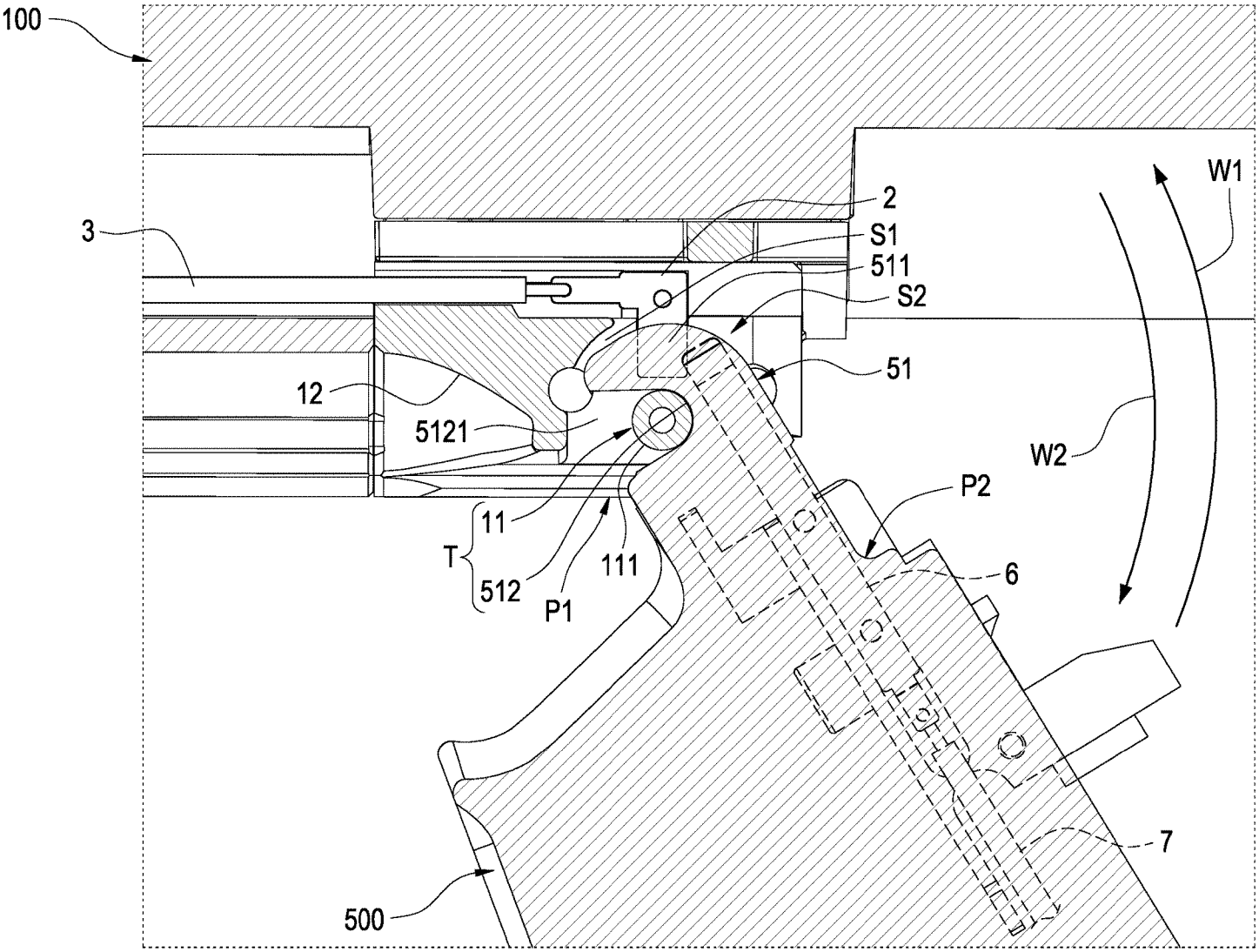
FIG. 10 is a side cross-sectional view showing the bending part of FIG. 9 according to the present disclosure.

Please refer from FIG. 1 to FIG. 6, the first gun body 100 has a first connection part P1 as shown in FIG. 9 and FIG. 10. The first gun body 100 is disposed with a pair of first conductive sheets 2 corresponding to the first connection part P1. Each of the first conductive sheets 2 is connected to each of the first conductive wires 3.

Please refer from FIG. 1 to FIG. 6, the second gun body 500 has a second connection part P2 as shown in FIG. 9 and FIG. 10. The second gun body 500 is disposed with a pair of second conductive sheets 6 corresponding to the second connection part P2. Each of the second conductive sheets 6 is connected to each of the second conductive wires 7.

The first connection part P1 and the second connection part P2 are rotatably connected, and a bending part T is formed after the first connection part P1 and the second connection part P2 are connected. Please refer to FIG. 9 and FIG. 10, the second gun boy 500 counterclockwise rotates relative to the first gun body 100 with the bending part T as an axle to form a rotating assembly way W1 to make the first gun body 100 and the second gun body 500 be mutually assembled. The second gun boy 500 is clockwise bent (rotated) relative to the first gun body 100 with the bending part T as the axle to form a bending detach way W2, thus the second gun body 500 is bent relative to the first gun body 100 to form a substantial L shape (in some embodiment, an included angle formed after the bending operation is greater than 90 degrees). Please refer to FIG. 1 and FIG. 6, when the second gun body 500 is bent relative to the first gun body 100 along the rotating assembly way W1, each of the second conductive sheets 6 is correspondingly in contact with each of the first conductive sheets 2 at the substantial terminal end of the rotating assembly way W1 to establish an electric conducting connection. In other words, a user only needs to rotate to assemble the second gun body 500, each of the first conductive sheets 2 and each of the second conductive sheets 6 are in contact and electrically connected during the rotating assembly operation, thus the electric power supplied by the power supplying unit is transferred to the power consuming unit via each of the first conductive sheets 2 and each of the second conductive sheets 6. Accordingly, the manual operating of electric connection is not required after the rotating assembly operation is finished, in other words the function of rapidly connecting the electric signal is provided.

Please refer to FIG. 9 and FIG. 10, when the second gun body 500 is bent relative to the first gun body 100 and along the bending detach way W2, each of the second conductive sheets 6 correspondingly separates with each of the first conductive sheets 2 at the substantial terminal end of the bending detach way W2 to terminate the electric connection. In other words, the user only needs to bend to detach the second gun body 500 along the bending detach way W2, each of the first conductive sheets 2 and each of the second conductive sheets 6 are separated to terminate the electric power supplied by the power supplying unit to the power consuming unit. Accordingly, the manual operating of detaching is not required after the bending operation is finished, in other words the function of rapidly terminating the electric signal is provided.

According to the present disclosure, the rotatably connecting manner of the first connection part P1 and the second connection part P2 is not intended to be limiting.

In some embodiments, the first gun body 100 is disposed with a rotation shaft 11 and a block wall 12 corresponding to the location of the first connection part P1. The rotation shaft 11 is a part of the bending part T. In some embodiments, the first gun body 100 includes a first gun member 1, two opposite sides of the first gun member 1 may be extended with the rotation shafts 11, and may be extended with the block walls 12. Please refer to FIG. 3 and FIG. 10, each of the block walls 12 partially surrounds an axial circumferential surface 111 of each of the rotation shafts 11. As shown in figures, the partially surrounding manner is to partially surround the axial circumferential surface 111 in a fan-shaped range defined as substantial 90 degrees of the 360 degrees, thus a position limiting space S1 is formed between each of the block walls 12 and each of the axial circumferential surfaces 111, and an opened space S2 is formed in another range of the axial circumferential surface 111 which is not surrounded in the 360 degrees.

The second gun body 500 is extended with a connection head 51 corresponding to the location of the second connection part P2. The connection head 51 is disposed with a shaft hole 512 and formed with a limited segment 511. One distal hole end of the shaft hole 512 is a closed end. A notch 5121 communicating with the exterior is formed on a hole peripheral wall of the shaft hole 512. The shaft hole 512 is another part of the bending part T. In other words, the rotation shaft 11 and the shaft hole 512, which are axially connected, form the bending part T. In some embodiments, the second gun body 500 includes a second gun member 5*a*. The second gun member 5*a* may be extended with a pair of the connection heads 51.

Figure 1:
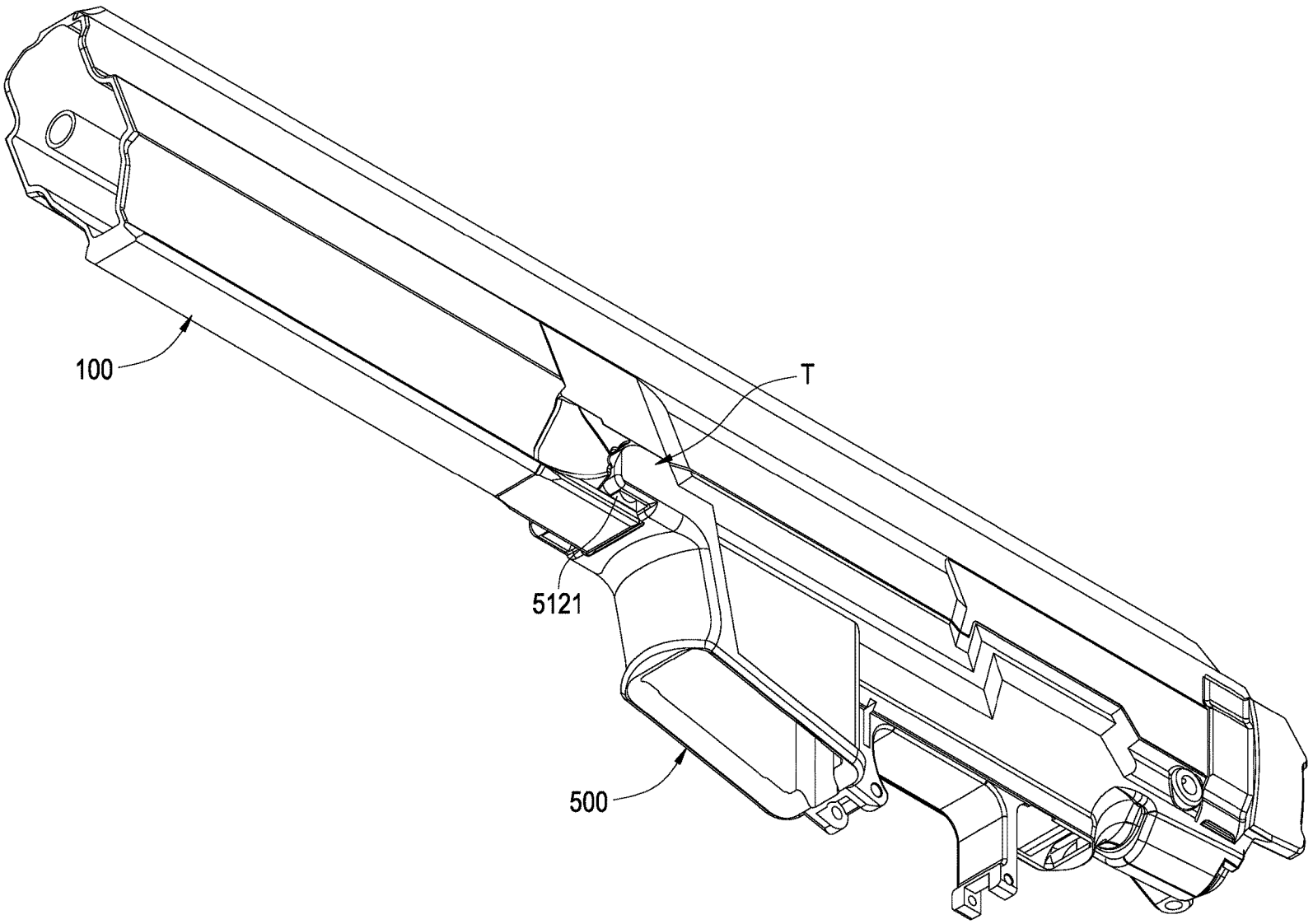
FIG. 1 is a perspective view showing the first gun body and the second gun body being rotating to assemble according to the present disclosure.
Figure 2:
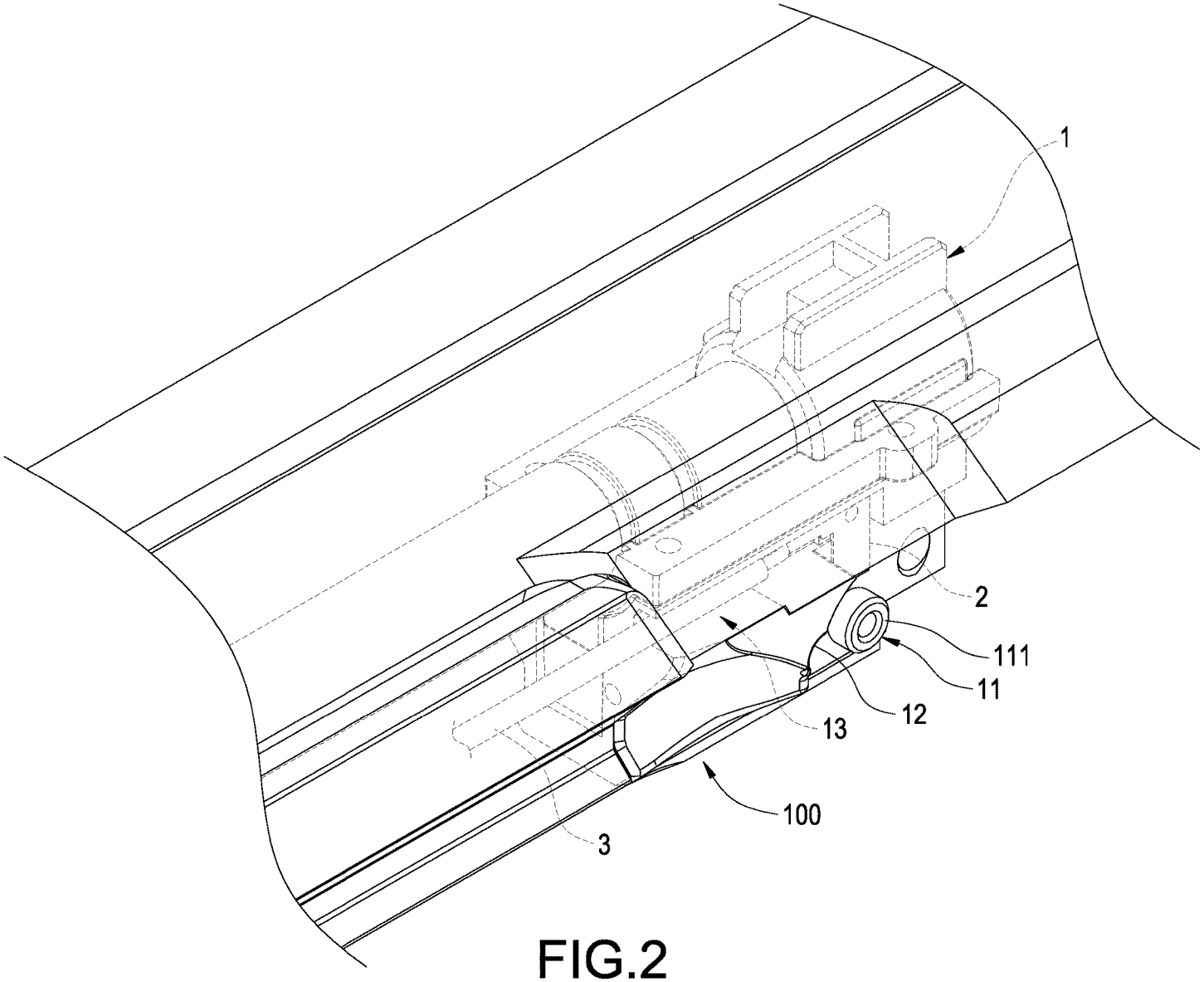
FIG. 2 is a perspective partially enlarged view showing the first gun body according to the present disclosure.
Figure 6:
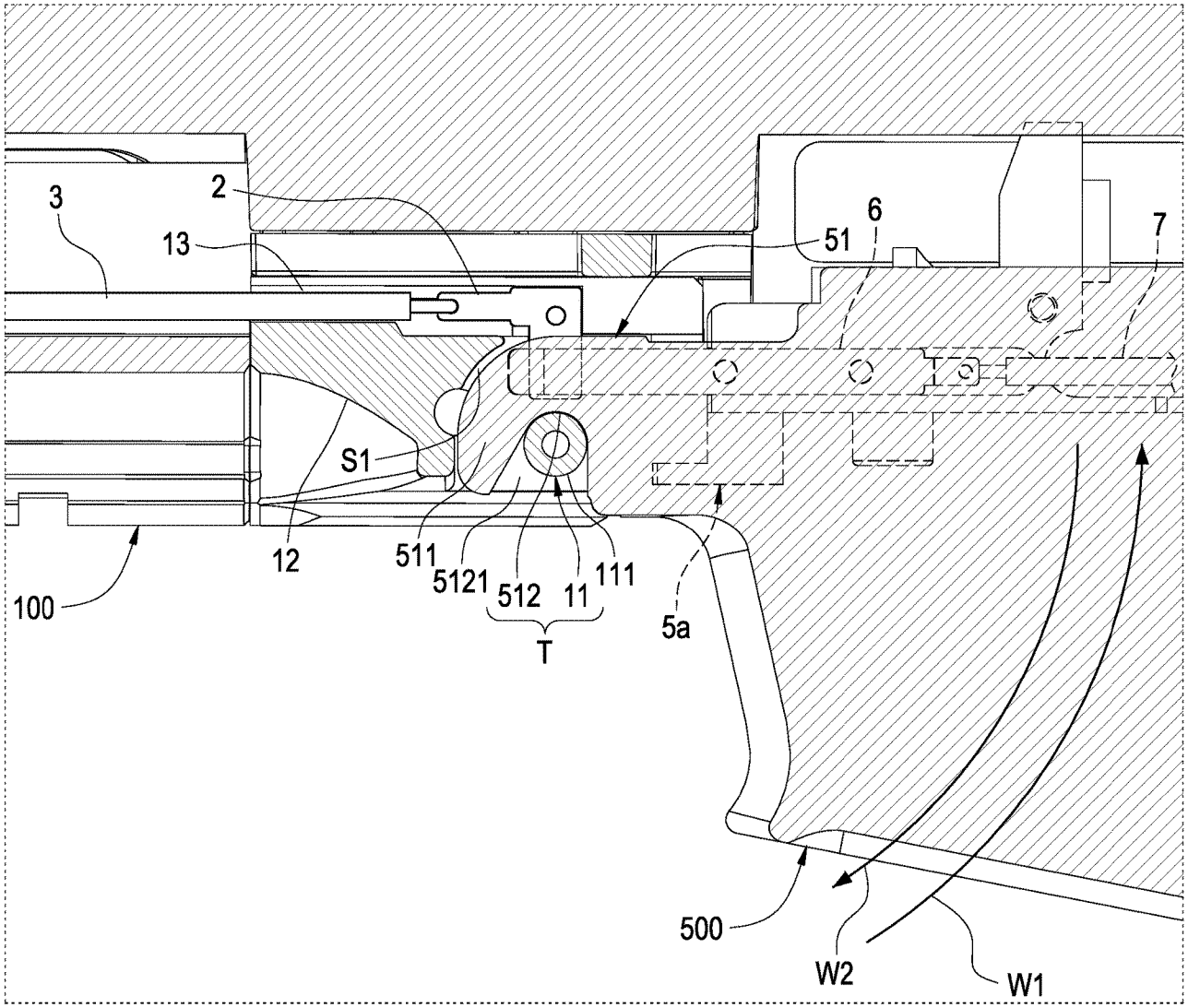
FIG. 6 is a side cross-sectional view showing the bending part of FIG. 1 according to the present disclosure.

As shown in FIG. 1 and FIG. 6, each of the connection heads 51 rotatably and partially sheaths each of the rotation shafts 11 via the shaft hole 512. The limited segment 511 of each of the connection heads 51 is correspondingly assembled in each of the position limiting spaces S1 to be limited at the terminal end of the rotating assembly way W1. At this moment, each of the connection heads 51 may only be moved toward the direction of the opened space S2 to be released from the first gun body 100, but temporarily may not be moved toward the direction of the opened space S2 due to each of the limited segments 511 being limited in each of the position limiting spaces S1. Accordingly, the gun body of the electric toy gun of the present disclosure is in an assembled status, and each of the first conductive sheets 2 and each of the second conductive sheets 6 are in contact and electrically conduct the electric signal between the power supplying unit and the power consuming unit in the assembled status.

As shown in FIG. 9 and FIG. 10, when objects or components in the electric toy gun of the present disclosure are desired to be repaired or replaced, the second gun body 500 is bent relative to the first gun body 100 and along the bending detach way W2 to make each of the limited segments 511 be moved out from each of the position limiting spaces S1, thus each of the connection heads 51 is moved toward the direction of the opened space S2 to be released from the first gun body 100. Details are provided as follows. When the second gun body 500 is bent relative to the first gun body 100 and along the bending detach way W2 (only being bent and yet being released), at this moment the gun body of the electric toy gun of the present disclosure is in a bent status, each of the second conductive sheets 6 is separated with each of the first conductive sheets 2 at the substantial terminal end of the bending detach way W2 to make the electric signal between the power supplying unit and the power consuming unit be terminated. In other words, the electric toy gun of the present disclosure achieves the electric connection or the electric termination when being bent, and the second gun body 500 is completely detached from the first gun body 100 after being bent to the substantial L shape to make the first gun body 100 and the second gun body 500 be completely separated.

Figure 3:
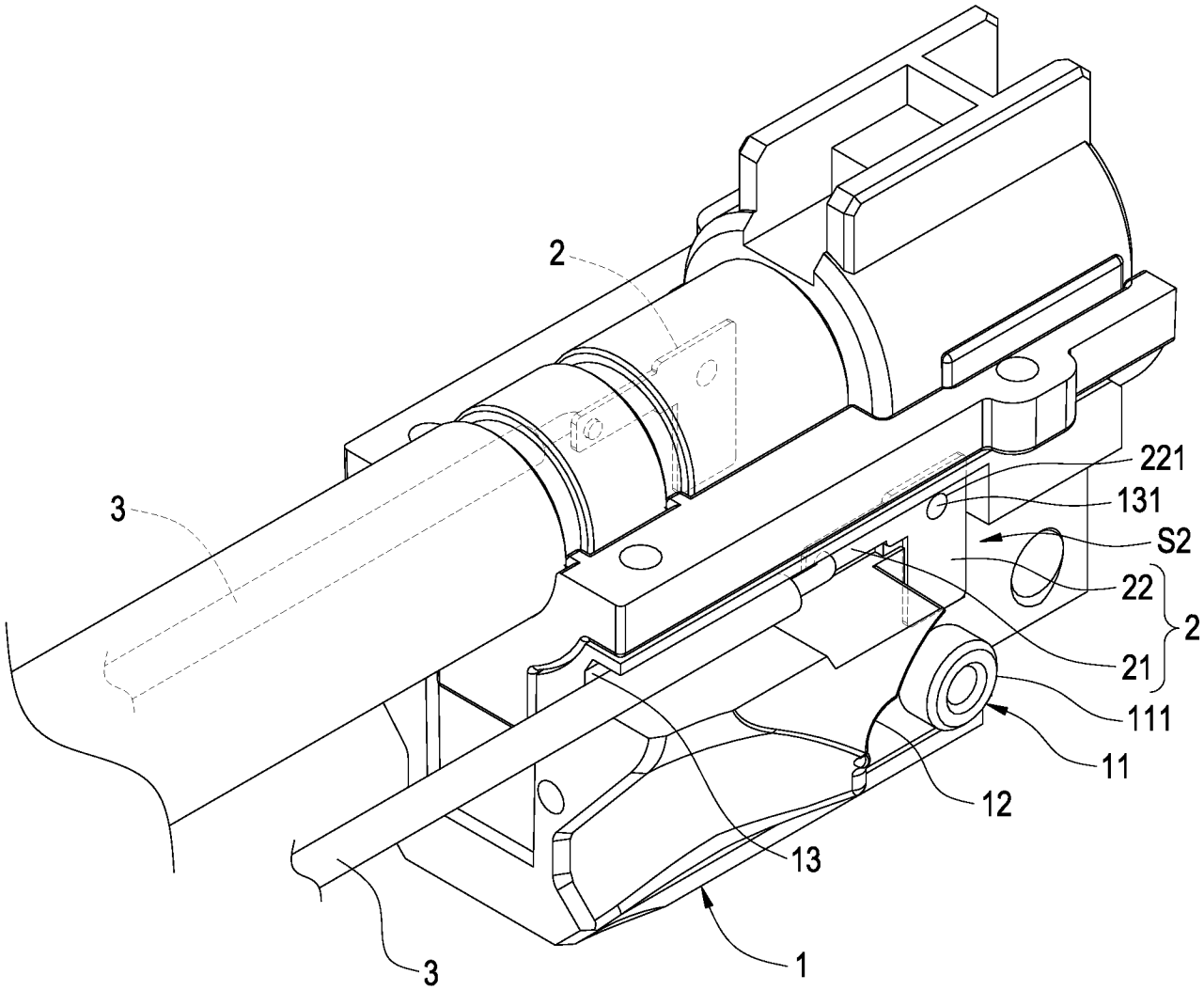
FIG. 3 is another perspective partially enlarged view showing the first gun body according to the present disclosure.
Figure 7:
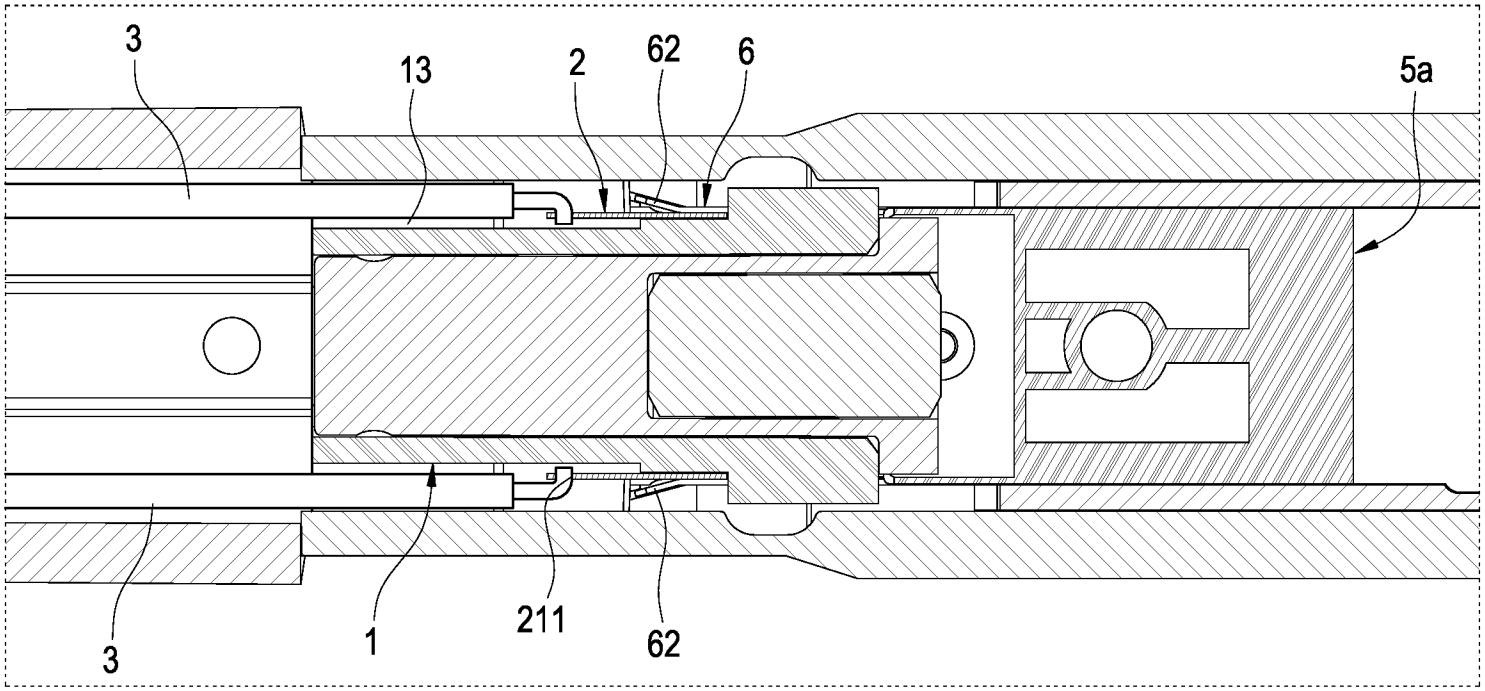
FIG. 7 is a top cross-sectional view showing the bending part of FIG. 1 according to the present disclosure.
Figure 8:
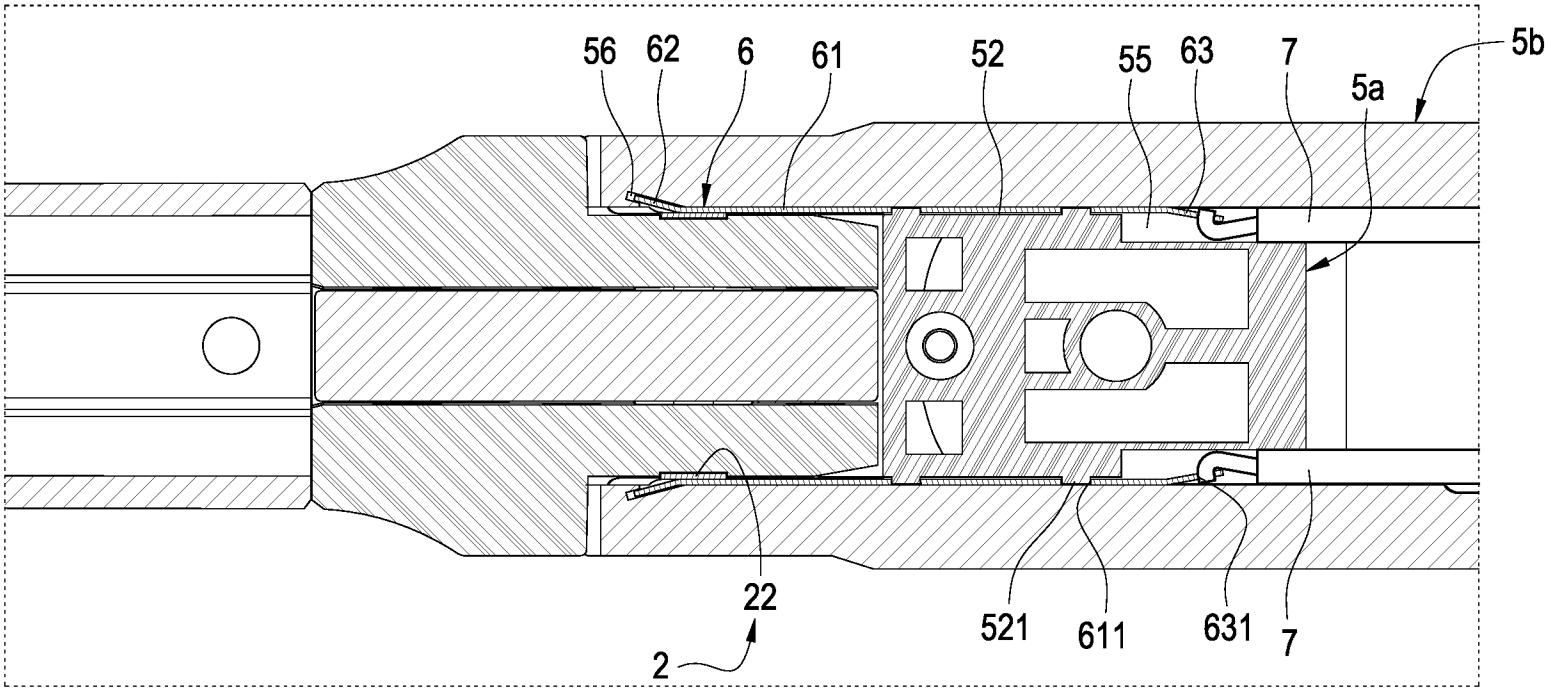
FIG. 8 is another side cross-sectional view showing the bending part of FIG. 1 according to the present disclosure.

Details are provided as follows. As shown in FIG. 3, FIG. 7 and FIG. 8, two outer opposite sides of the first gun member 1 are formed with a wire passing slot 13. Each of the first conductive wires 3 is mounted in each of the wire passing slots 13. It should be noted that, as shown in FIG. 3, FIG. 6 and FIG. 10, each of the first conductive sheets 2 is flatly fastened at two outer opposite sides of the first gun member 1 in each of the opened spaces S2. When the first conductive wire 3 is required to be moved to make an exposed wire segment (not labeled in figures) of the first conductive wire 3 pass a wire inserting hole 211 (as shown in FIG. 7) of the first conductive sheet 2, a sufficient action space is formed because the first conductive sheet 2 is located in the opened space S2, thus an effect of making the exposed wire segment of each of the first conductive wires 3 easily pass and be connected to each of the first conductive sheets 2 is provided.

Please refer to FIG. 4, FIG. 5, FIG. 6 and FIG. 10, the second gun body 500 further includes a second gun case 5*b*. The second gun member 5*a* is disposed in the second gun case 5*b*. Two outer opposite sides of the second gun member 5*a* are disposed with a sheet slot 52, and disposed with a bypass slot 55. Each of the sheet slots 52 is connected and communicates with each of the bypass slots 55. The depth of the bypass slot 55 is greater than the depth of the sheet slot 52. The second conductive sheet 6 is divided as a conductive sheet member 61, a positioning end 62 and a wire connecting end 63. The positioning end 62 and the wire connecting end 63 are located at a head end and a distal end of the conductive sheet member 61. Each of the second conductive wires 7 is connected to each of the wire connecting ends 63. Each of the second conductive wires 7 has a wire end part 71 close to each of the wire connecting ends 63. Each of the wire end parts 71 is mounted in each of the bypass slots 55. Each of the second conductive sheets 6 is mounted in each of the sheet slots 52, and each of the wire connecting ends 63 is disposed in each of the bypass slots 55. The two wire connecting ends 63 are inward and oppositely bent toward depth directions of the two bypass slots 55, thus each of the wire connecting ends 63 is away from the second gun case 5*b* to form a sufficient action space, and the second conductive wire 7 is moved to make an exposed wire segment (not labeled in figures) of the second conductive wire 7 pass a wire inserting hole 631 of the second conductive sheet 6, an effect of making the exposed wire segment of each of the second conductive wires 7 easily pass and be connected to each of the second conductive sheets 6 is provided.

Figure 5:
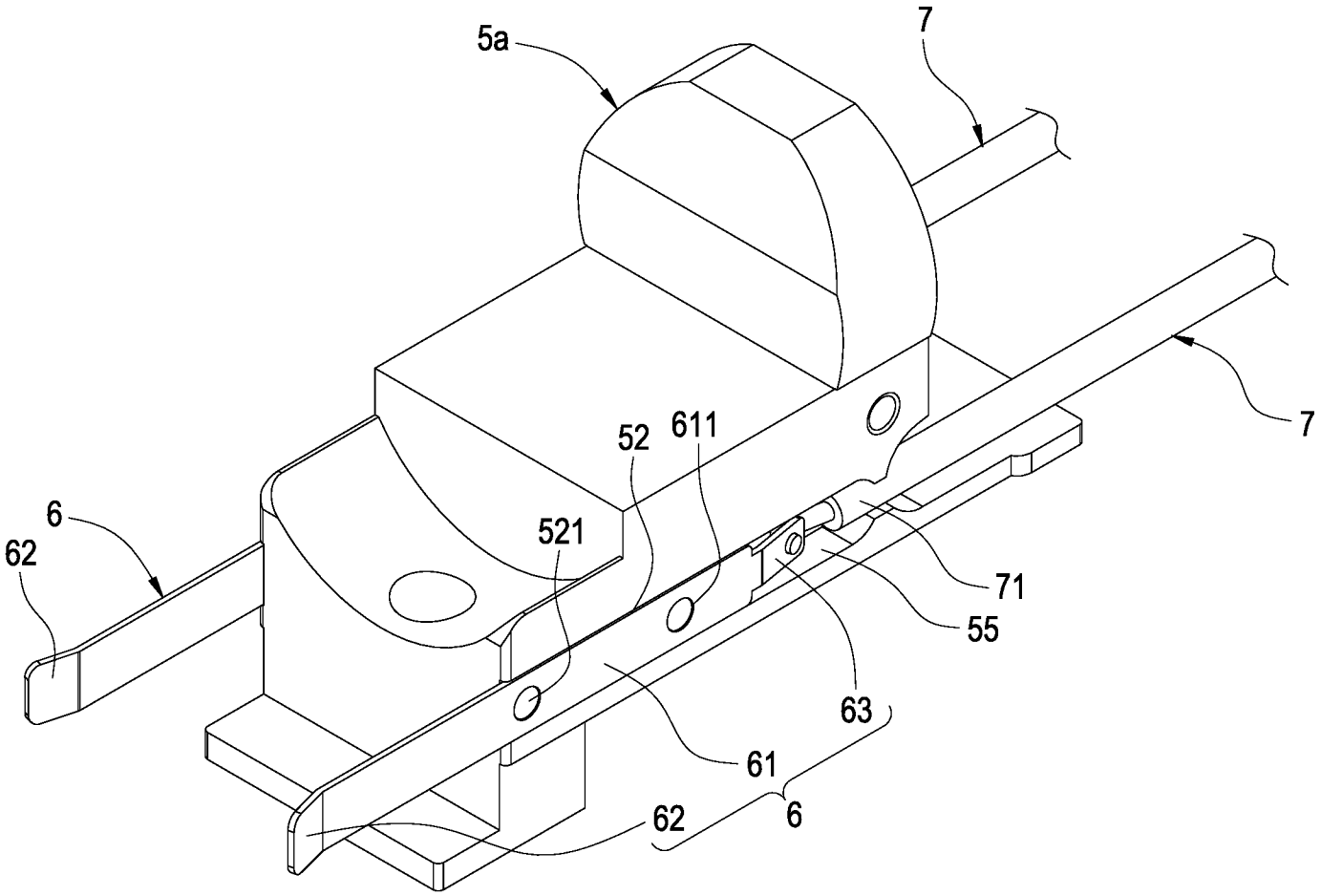
FIG. 5 is a perspective partially enlarged view showing the second gun body (not including the second gun case) according to the present disclosure.

As shown in FIG. 5 and FIG. 7, the two positioning ends 62 are outward and oppositely bent in directions opposite to the depth directions of the two bypass slots 55, thus each of the positioning ends 62 is bent with an angle relative to each of the conductive sheet members 61, and the two first conductive sheets 2 are disposed between the two second conductive sheets 6. As such, the two first conductive sheets 2 are smoothly stacked on the two conductive sheet members 61, and an effect of not being interfered by the two second conductive sheets 6 and not being in contact with the two second conductive sheets 6 during the stacking process is provided.

Figure 4:
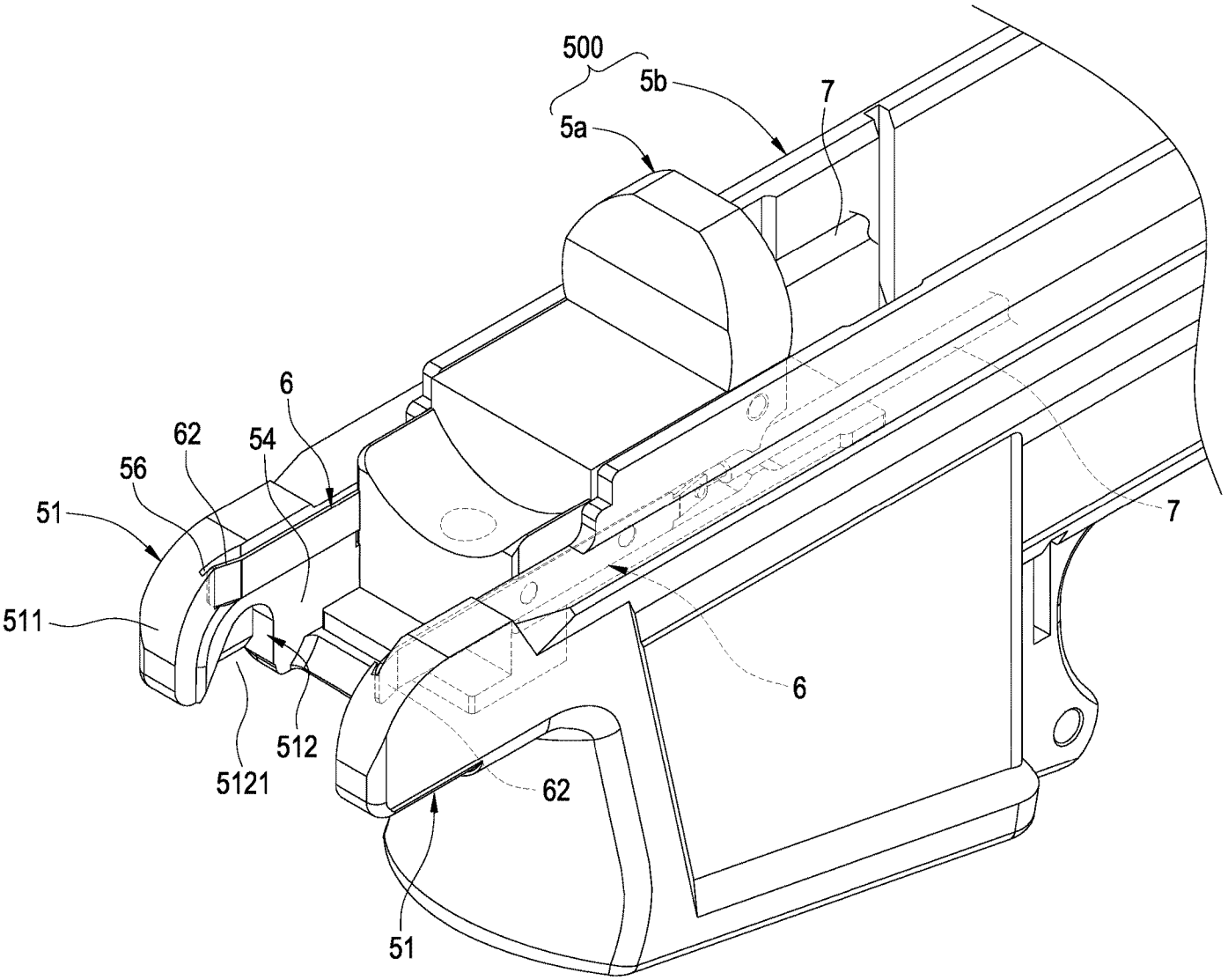
FIG. 4 is a perspective partially enlarged view showing the second gun body (including the second gun case) according to the present disclosure.

In some embodiments, an inner case wall 54 of the second gun case 5*b* is formed with two positioning slots 56 as shown in FIG. 4, FIG. 5 and FIG. 8. Each of the positioning ends 62 is inserted in each of the positioning slots 56 to make each of the second conductive sheets 6 be precisely positioned on the second gun member 5*a*, thus the process of the each of the first conductive sheets 2 being stacked on each of the conductive sheet members 61 not being interfered by each of the second conductive sheets 6 is ensured, and each of the first conductive sheets 2 being precisely stacked on each of the conductive sheet members 61 is ensured, and a certain stacking strength provided between each of the first conductive sheets 2 and each of the conductive sheet members 61 is ensured to increase the electric conducting effect.

It should be noted that, as shown in FIG. 3, the first conductive sheet 2 has a first segment 21 and a second segment 22 which are crossly connected. The first segment 21 is connected to the first conductive wire 3, and the second segment 22 is used to be stacked on the conductive sheet member 61 as shown in FIG. 8.

According to the present disclosure, the fastening manner of the first conductive sheet 2 and the second conductive sheet 6 is not intended to be limiting. In some embodiments, each of the first conductive sheets 2 is formed with a fastening hole 221, and two opposite sides of the first gun member 1 are disposed protrusively with a fastening piece 131 as shown in FIG. 3. Each of the fastening pieces 131 is thermally melted to be connected in each of the fastening holes 221. In some embodiments, the conductive sheet member 61 of each of the second conductive sheets 6 is formed with a plurality of fastening holes 611, and two opposite sides of the second gun member 5*a* are formed with a plurality of fastening pieces 521 as shown in FIG. and FIG. 8. Each of the fastening pieces 521 is thermally melted to be connected in each of the fastening holes 611. In some other embodiments, each fastening member may be fastened on the first gun member 1 and the second gun member 5*a* corresponding to each of the fastening holes 221, 611 with another manner, for example a riveting manner.

While this disclosure has been described by means of specific embodiments, numerous modifications and variations could be made thereto by those skilled in the art without departing from the scope and spirit of this disclosure set forth in the claims.

What is claimed is:

1. An assembled electric toy gun, comprising:

a first toy gun body, comprising a first connection part and a pair of first conductive sheets disposed corresponding to the first connection part; and a second toy gun body rotatably connected to the first toy gun body, comprising a second connection part and a pair of second conductive sheets disposed corresponding to the second connection part;

wherein, the first connection part and the second connection part are pivotally connected to be a bending part, the pair of first and the pair of second conductive sheets are located adjacent to the bending part, the second toy gun body is configured to rotate relative to the first toy gun body in opposite directions via the bending part to respectively define a rotating assembly way and a bending detach way, each of the second conductive sheets is correspondingly in contact with each of the first conductive sheets at a terminal end of the rotating assembly way to establish an electric conduction, and each of the second conductive sheets is correspondingly separated from each of the first conductive sheets at a terminal end of the bending detach way to terminate the electric conduction.

2. The assembled electric toy gun according to claim 1, wherein the first toy gun body comprises a rotation shaft and a block wall disposed corresponding to the first connection part, the rotation shaft comprises an axial circumferential surface, the block wall partially surrounds the axial circumferential surface to define a position limiting space; the second toy gun body comprises a connection head extended corresponding to the second connection part, the connection head comprises a shaft hole and a limited segment, the shaft hole is defined with a notch, the connection head is adapted to rotatably and partially sheath the rotation shaft via the shaft hole, the limited segment is correspondingly assembled in the position limiting space at the terminal end of the rotating assembly way, and the limited segment is moved out from the position limiting space at the terminal end of the bending detach way.

3. The assembled electric toy gun according to claim 1, wherein each of the second conductive sheets is stacked on each of the first conductive sheets at the terminal end of the rotating assembly way.

4. The assembled electric toy gun according to claim 1, wherein the first toy gun body comprises a first gun member, the first gun member comprises two wire passing slots, each of the first conductive sheets is connected to a first conductive wire, and two first conductive wires are embedded in the two wire passing slots respectively.

5. The assembled electric toy gun according to claim 1, wherein the second toy gun body comprises a second gun member, the second gun member comprises two sheet slots, and each of the second conductive sheets is embedded in each of the sheet slots.

6. The assembled electric toy gun according to claim 5, wherein two positioning ends of the two second conductive sheets are bent outward in opposite direction, and the two first conductive sheets are disposed between the two second conductive sheets and arranged to be in contact with the two second conductive sheets.

7. The assembled electric toy gun according to claim 6, wherein the second toy gun body further comprises a second toy gun case, the second gun member is disposed in the second gun case, the second gun case comprises two positioning slots, and each of the positioning ends is inserted in each of the positioning slots.

8. The assembled electric toy gun according to claim 5, wherein the second gun member further comprises two bypass slots, each of the sheet slots is connected and communicates with each of the bypass slots, a wire connecting end of each of the second conductive sheets is disposed in each of the bypass slots, and two wire connecting ends of the two second conductive sheets are bent inward correspondingly, the wire connecting end of each of the second conductive sheets is connected to a second conductive wire, a wire end part of the second conductive wire close to each of the wire connecting ends is embedded in each of the bypass slots.

9. The assembled electric toy gun according to claim 1, wherein the second toy gun body comprises a second gun member, the second gun member comprises two bypass slots, a wire connecting end of each of the second conductive sheets is disposed in each of the bypass slots, and two wire connecting ends of the two second conductive sheets are bent inward correspondingly, the wire connecting end of each of the second conductive sheets is connected to a second conductive wire, a wire end part of the second conductive wire close to each of the wire connecting ends is embedded in each of the bypass slots.

* * * * *